US008100724B2

(12) United States Patent
Lin et al.

(10) Patent No.: US 8,100,724 B2
(45) Date of Patent: Jan. 24, 2012

(54) ELECTRICAL CONNECTOR FEATURED USB/ESATA INTERFACES

(75) Inventors: Chih-Nan Lin, Tu-Cheng (TW); Kuo-Chun Hsu, Tu-Cheng (TW); Hung-Chi Yu, Tu-Cheng (TW); Jui-Kuang Chung, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/701,607

(22) Filed: Feb. 8, 2010

(65) Prior Publication Data

US 2010/0216327 A1 Aug. 26, 2010

(30) Foreign Application Priority Data

Feb. 23, 2009 (TW) ..... 98105665 A

(51) Int. Cl.
*H01R 33/00* (2006.01)

(52) U.S. Cl. ..... 439/630; 439/660; 439/218

(58) Field of Classification Search ..... 439/660, 439/218, 630
See application file for complete search history.

(56) References Cited

U.S. PATENT DOCUMENTS

| | | | | |
|---|---|---|---|---|
| 7,247,051 | B2 | 7/2007 | Hou | |
| 7,371,116 | B2 | 5/2008 | Chiang | |
| 7,517,253 | B1 * | 4/2009 | Chiang | 439/660 |
| 7,578,705 | B2 * | 8/2009 | He et al. | 439/660 |
| 7,628,658 | B1 * | 12/2009 | Chiang | 439/709 |
| 7,824,220 | B2 * | 11/2010 | Chen | 439/607.35 |

* cited by examiner

*Primary Examiner* — Truc Nguyen
(74) *Attorney, Agent, or Firm* — Wei Te Chung; Andrew C. Cheng; Ming Chieh Chang

(57) ABSTRACT

An electrical connector includes an insulating housing and contacts, the insulating housing defines a mating cavity and a tongue portion in the cavity, the tongue portion defines a first and a second mating face. A set of first contacts each defines a first contacting section disposed on the first mating face and a leg portion. A set of second contacts each defines a first contacting section disposed on the first mating face and a second contacting section bending from the first contacting section to be in the second mating face, a leg portion and a retention section connecting with the first contacting section and a the leg portion. A set of third contacts each defines a contacting section disposed on the second mating face and a leg section. The contacting portions of the third contacts are disposed at two sides of the second contacting sections of the second contact.

12 Claims, 6 Drawing Sheets

ELECTRICAL CONNECTOR FEATURED USB/ESATA INTERFACES

BACKGROUND OF THE INVENTION

1. Field of the Invention

The present invention relates to an electrical connector, and more particularly to an electrical connector compatible to standards of Universal Serial Bus (USB) and External Serial Advanced Technology Attachment (eSATA) protocols.

2. Description of the Related Art

U.S. Pat. No. 7,625,243 issued to a same assignee of the instant application discloses a new design USB 3.0 connector which contains additional five contacts in comparison with the standard USB 2.0 connector while still keeping the similar mating port dimension thereof so as to be compatible with the standard USB 2.0 connector, thus assuring there is no conflict therebetween during the upgrading transition period.

On the other hand, some variation of USB 2.0 connector was presented in which a combo type connector which somewhat enlarged the mating port dimension so as to provide another space for receiving an eSATA connector in the same mating port.

SUMMARY OF THE INVENTION

The invention is to provide a triple combo type connector which is mateable with the standard USB 2.0 connector, USB 3.0 connector and the eSATA connector, respectively.

An electrical connector comprises an insulating housing and contacts, the insulating housing defines a mating cavity with a forward opening and a tongue portion in the mating cavity, the tongue portion defines a first mating face and a second mating face opposite to the first mating face. A set of first contacts each defines a first contacting section disposed on the first mating face and a leg portion. A set of second contacts each defines a first contacting section disposed on the first mating face and a second contacting section bending from the first contacting section to be in the second mating face, a leg portion and a retention section connecting with the first contacting section and the leg portion which retain the second contact in the housing. A set of third contacts each defines a contacting section disposed on the second mating face of the tongue portion and a leg section. The contacting portions of the set of the third contacts are disposed at two sides of the second contacting sections of the set of the second contact.

Other advantages and novel features of the invention will become more apparent from the following detailed description of the present embodiment when taken in conjunction with the accompanying drawings.

DETAILED DESCRIPTION OF THE INVENTION

Figure 1:
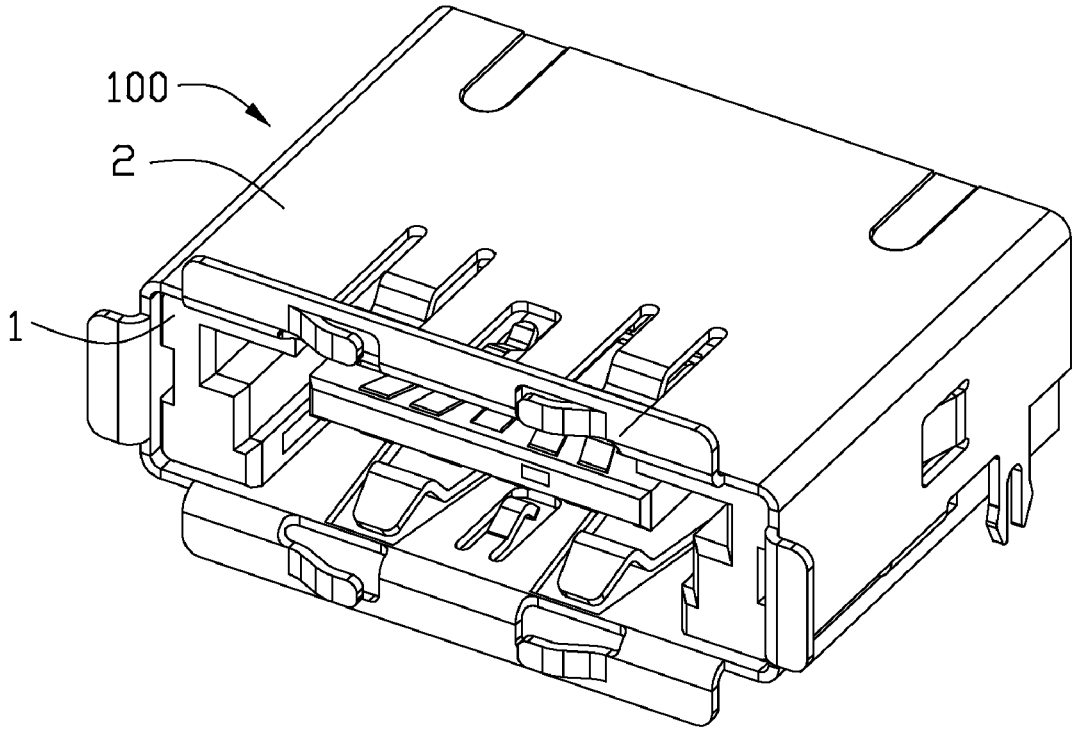
FIG. 1 is a perspective view of an electrical connector in accordance with the present invention.

Reference will now be made to the drawing figures to describe the preferred embodiments of the present invention in detail.

Figure 2:
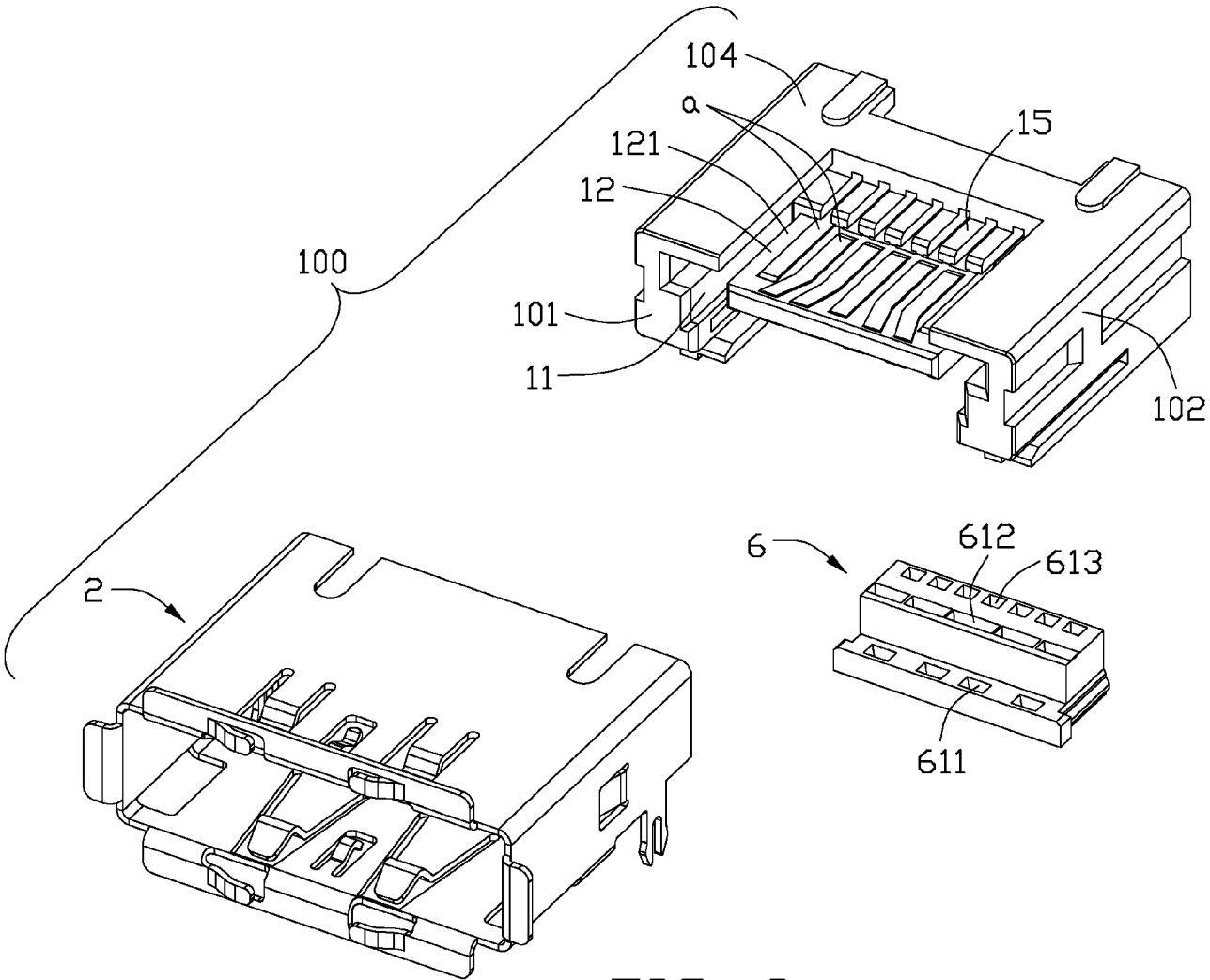
FIG. 2 is an exploded perspective view of the electrical connector shown in FIG. 1.

Referring to FIG. 1 and FIG. 2, disclosed here is an electrical connector 100 made in accordance with the present invention. The electrical connector 100 is adapted for USB 2.0, USB 3.0 or eSATA plug (not shown), which includes an insulating housing 1, a shielding shell 2 surrounding the housing 1 and a plurality of contacts retained to the housing 1.

Figure 3:
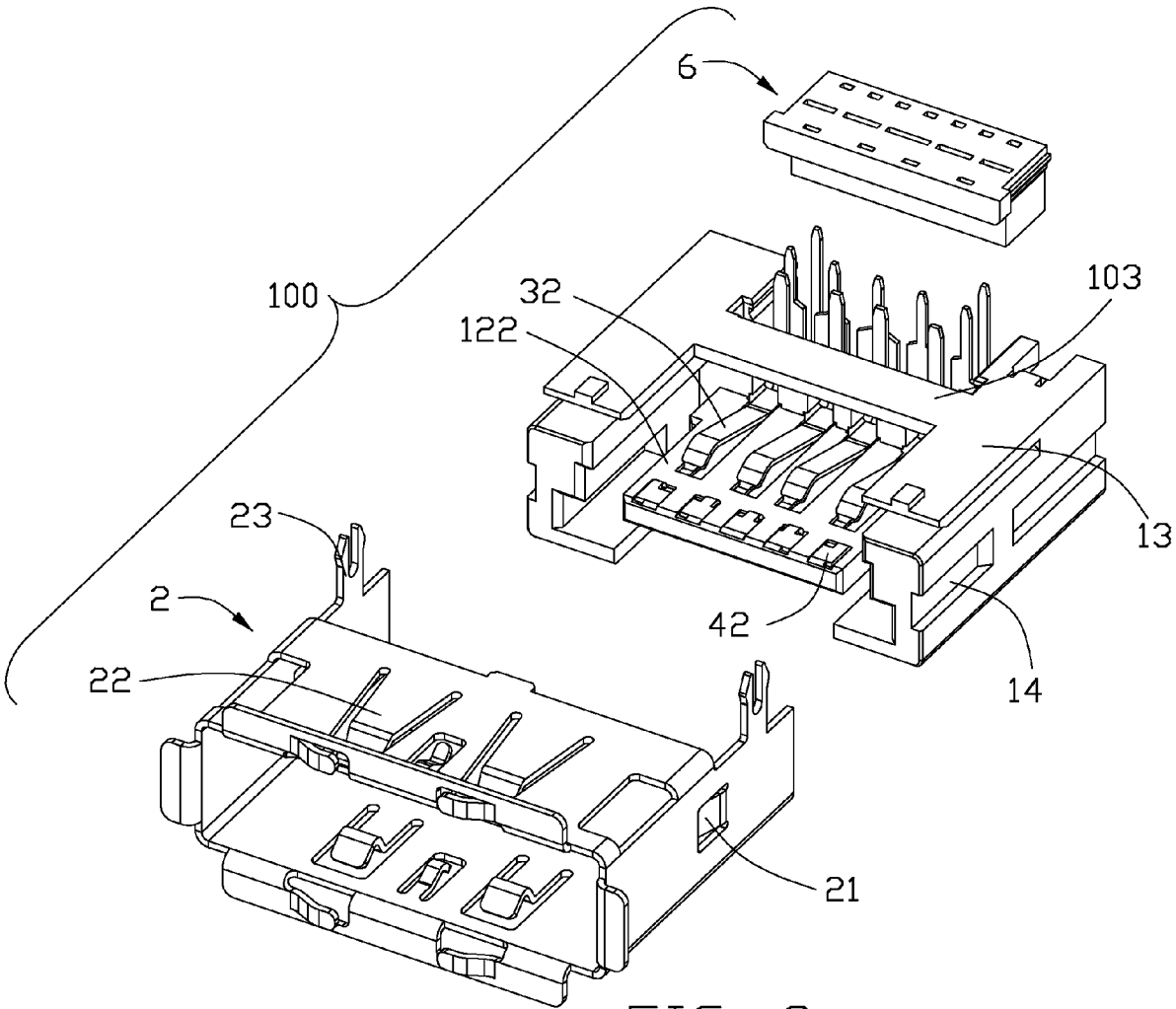
FIG. 3 is an exploded view of the electrical connector from A bottom view.

Referring to FIG. 2 and FIG. 3, the insulating housing 1 defines a mating cavity 11 with a front opening running through a front face 101. A pair of opposite sidewalls 102 surrounding the mating cavity 11 has a stepped inside surface which forms a USB plug outline and an eSATA plug outline. A mating tongue portion 12 spaced away from said opposite sidewalls 102, extends from a rear wall or seat portion 103 in the mating cavity 11, which has an upper face 121 and a lower face 122 for contacts' arrangement. The lower face or the first mating face 122 is defined with a set of four elastic contacting sections 32 which adapted for engagement with the USB 2.0 plug and a set of five non-elastic contacting sections 42 near to the contact sections 32. Said two set of contacting sections 32, 42 are adapted for engagement with the USB 3.0 plug, the set of five non-elastic contacting sections are named as USB 3.0 contacts for shot (indeed USB 3.0 contact includes contacts 32,42). The upper face or the second mating face 121 is defined with a set of seven non-elastic contacting sections (a) which are adapted for engagement with the ESATA plug. Said contacting sections 32, 42, (a) are arranged along a traverse direction perpendicular to a mating insertion direction of the connector. The USB 3.0 contacting section 42 is in front of and offset from the USB 2.0 contacting portion 32 along the insertion direction.

Figure 4:
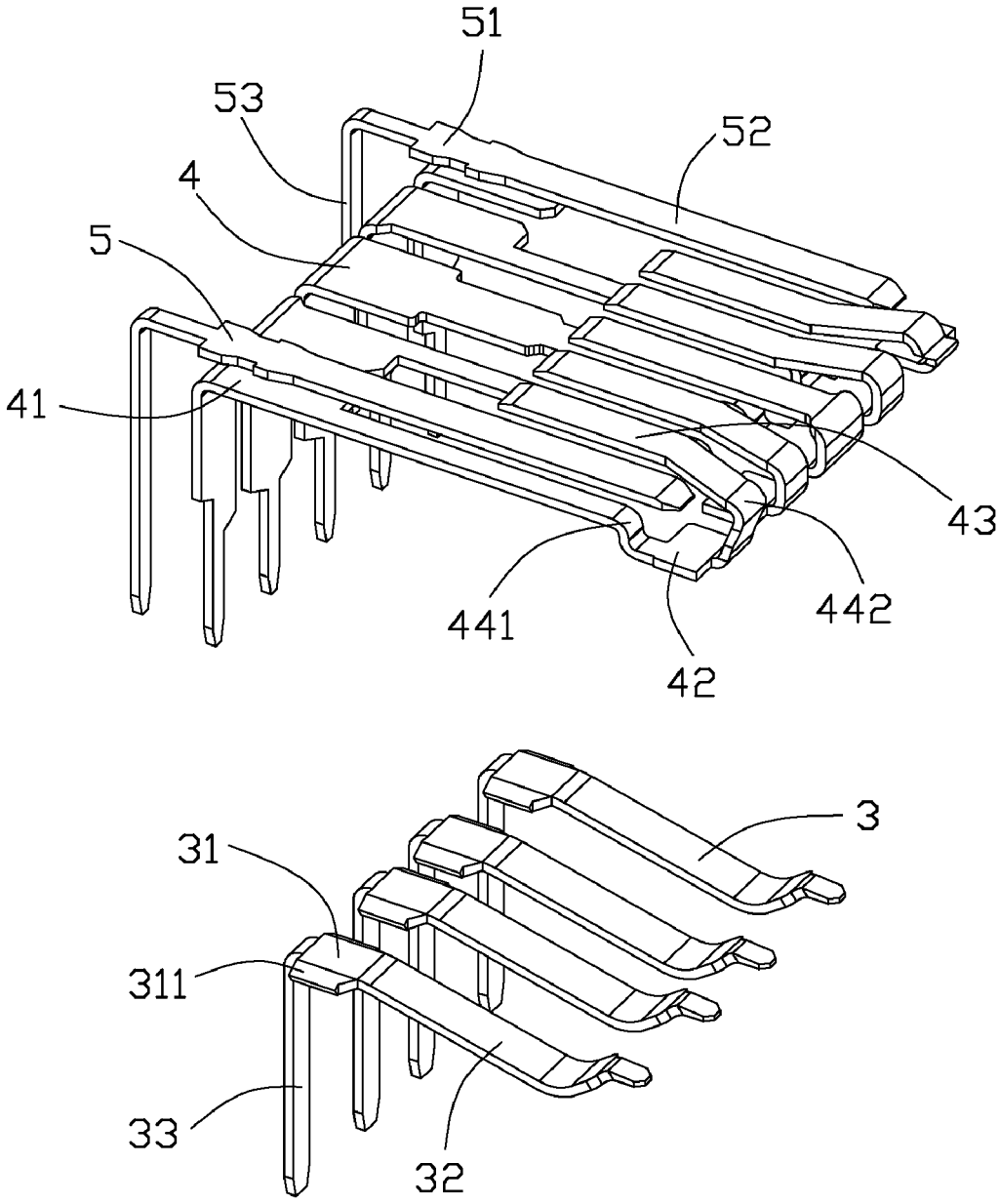
FIG. 4 is a perspective view of three sets of the contacts.
Figure 5:
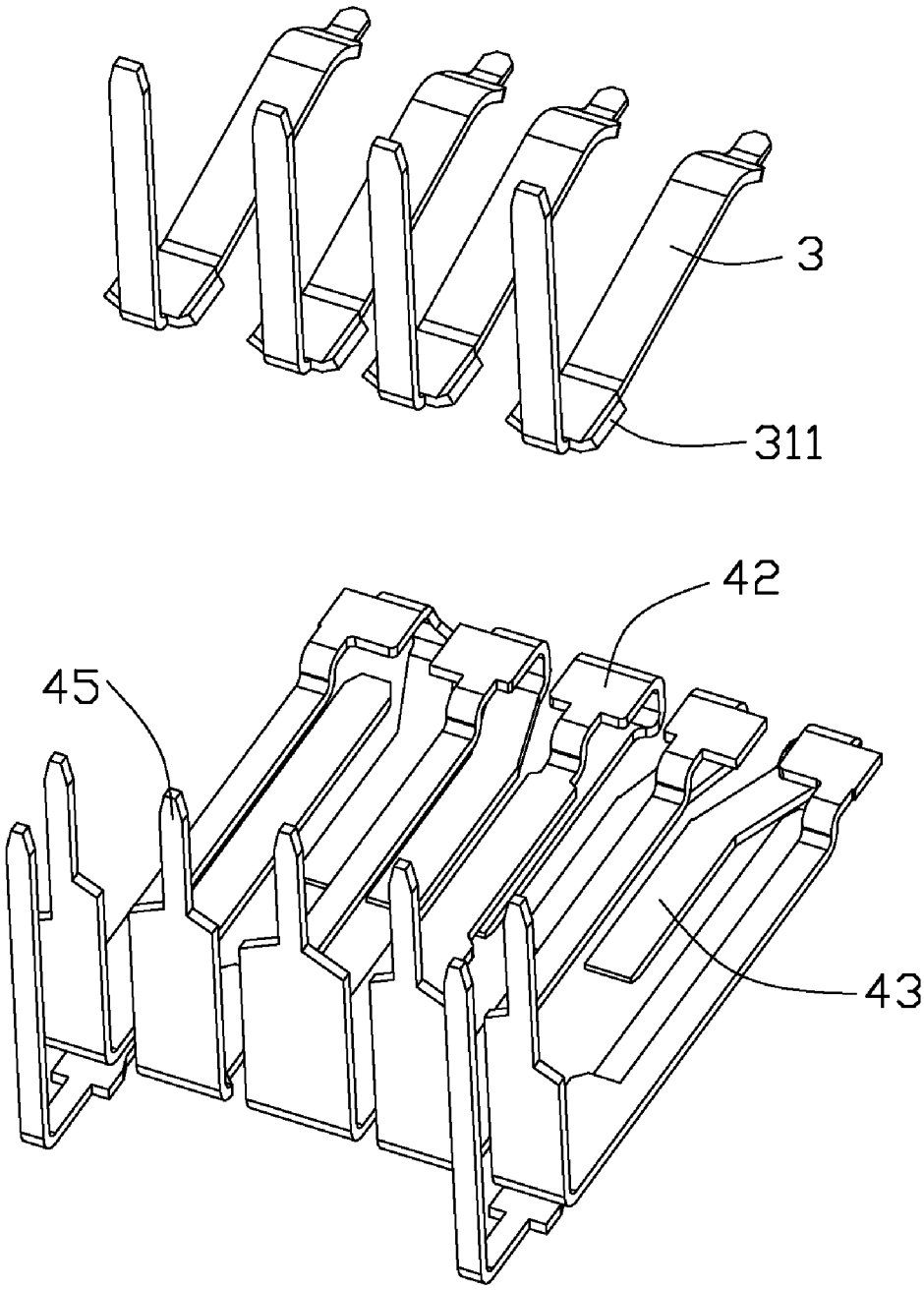
FIG. 5 is a perspective view of three sets of the contacts from a bottom view.
Figure 6:
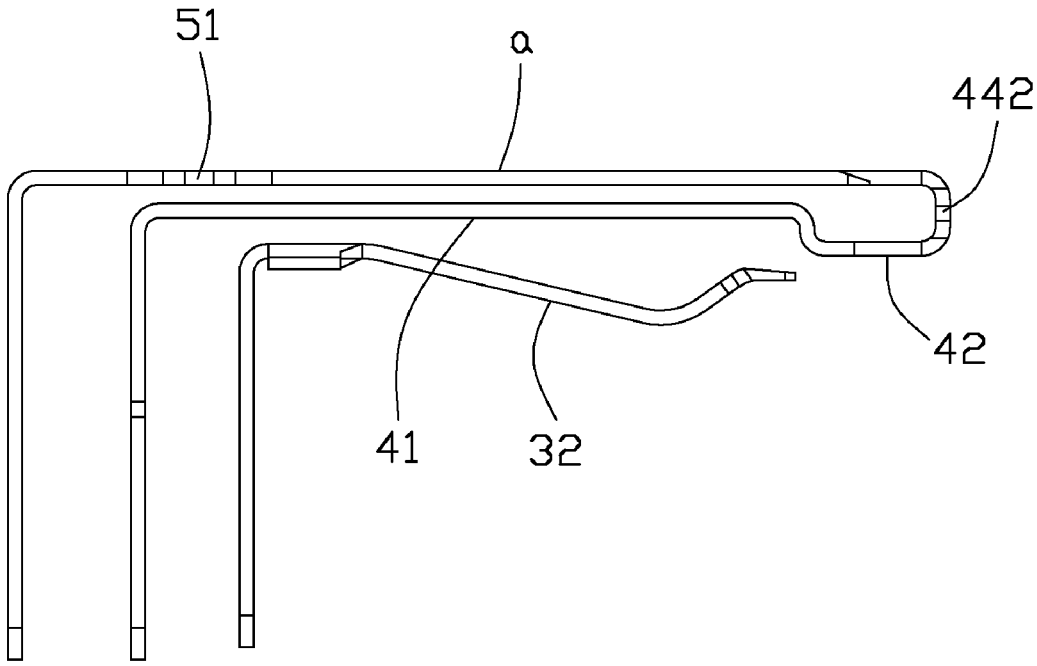
FIG. 6 is a right view of contacts of FIG. 4.

Referring to FIG. 4, each first contact 31 includes a retention section 31 retained in the seat portion 103, a leg section 33 bending downwards from the retention section 31 and the contacting section 32 which extends forwards from the retention section 31. Combination with FIG. 3, the first contacts 3 are inserted from the rear wall 103 and the contacting portions 32 are disposed in the passageways (not labeled) in the lower face 122 of the tongue portion 12 each with an arc portion projects into the mating cavity 11. Barbs 311 on lateral sides of the retention sections 31 bend downwards to retain in the passageways as best shown in FIG. 5.

Each second contact 4 includes a retention section 41 retained in the seat portion 103, a leg section 45 bending downwards from the retention section 41. The contacting section 42 (named as first contacting section hereinafter) extends forwards from the retention section 41 and another contacting section 43 (named as second contacting section hereinafter) bends upward from a front end of the first contacting section 42 while a rear end of the first contacting sections 42 is jointed with the retention section 41. The retention sections 41 of said five second contacts 4 are bedded in the tongue portion 12 and the first contacting sections 42 are formed lower than the retention sections 41 so as to explode to the lower face 122 of the tongue portion 12 while the second contacting portion 43 are formed higher than the retention section 41 so as to explode to the upper face 121 of the tongue portion 12. Each of five second contacts 4 includes a first connecting section 441 jointed with the retention section 41 and the first contact section 42, and a second connecting portion 442 jointed with the first contacting section 42 and said second contacting section 43. The second connecting section 442 of one of the second contacts 4 in middle thereof is symmetrical about an axis of the retention section 41 and the retainers of said four second contacts on the sides of the middle contacts are offset close to each other along the traverse direction. Thus said second contacting sections 43 have smaller distance between every one compared with the first contacting section 42. The width of the first contacting sections 42 is larger than the second contacting section 43.

Each of two third contacts 5 includes a retention section 51 and a contacting section 52 extending forwards from the retention section and a leg section 45 bending downwards from the retention section 51. Said third contacts 5 are disposed at two sides of the set of second contacts 4, respectively. Said two contacting section 52 are disposed at two sides of said five second contacting sections 43 in a common plane. The five second contacting sections 43 and said two contacting sections 52 commonly form said eSATA contacting sections (a) to engage with the ESATA lug.

After retained the contacts in the insulating housing 1, the contacting sections 32 of the set of first contacts 3 located in the lower face 122 of the tongue portion 12 server as first USB contacting sections. The first contacting sections 42 are also located on the lower face 122 of the tongue portion servers as second USB contacting sections, i.e., USB 3.0 contacting section. The second contacting portions 43 of the set of the second contacts 4 and the contacting sections 52 of the third contacts 5 are located in a same plane commonly and server as ESATA contacting sections.

A strength portion 15 is formed as at the intersection of the rear wall 103 and the tongue portion 12 to enlarge the rigidity of the root of the tongue portion 12. The second contacting sections 43 do not run through the root of the tongue portion 12.

As shown in FIGS. 2 and 3, an insulating positioning member 6 is provided on the housing. The position member 6 has three sets of upper-to-lower through holes 611,612,613 to assistance insertion of the leg sections of the contacts. A shielding shell 2 is provided for surrounding the insulating housing. A supporting board 13 extends forwards to support the bottom of the shell 2. The shell defines elastic arms 21 slant to and lock with recesses 14 on the outer of the sidewall 102, spring arm 22 slant in the mating cavity 10 to interference with a mating plug such as the USB 2.0 plug and a leg portion extending downward therefrom.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a mating cavity with a forward opening and a tongue portion in the mating cavity, the tongue portion defining a first mating face and a second mating face opposite to the first mating face;

a set of first contacts, each defining a contacting section disposed on the first mating face and a leg portion;

a set of second contacts, each defining a first contacting section disposed on the first mating face and a second contacting section bending from a first end of the first contacting section to be in the second mating face, a leg portion and a retention section, the retention section connecting with a second end opposite to said first end of the first contacting section and the leg portion;

a set of third contacts, each defining a contacting section disposed on the second mating face of the tongue portion and a leg section;

wherein the contacting portions of the set of the third contacts are disposed at two sides of the second contacting sections of the set of the second contacts.

2. The electrical connector as described in claim 1, wherein each of the first contacts and the third contacts comprises a retention section interconnecting with corresponding contacting section and corresponding leg portion at opposite ends of the retention section.

3. The electrical connector as described in claim 2, wherein the contacting sections of the first contacts are elastic and protrude in the mating cavity while the contacting sections of the second contacts and the third contacts are of plate shape.

4. The electrical connector as described in claim 3, wherein the first contacting sections of the second contacts are disposed nearer to the front opening than the contacting sections of the first contacts.

5. The electrical connector as described in claim 4, wherein the first contacting sections of the second contacts are disposed nearer to the front opening than the second contacting section of the second contacts.

6. The electrical connector as described in claim 5, wherein the retention sections of the second contacts are disposed nearer to the first mating face than the retention sections of the third contacts.

7. The electrical connector as described in claim 2, wherein the retention of the first contacts defines barbs at lateral sides thereof, the barbs bend in a direction perpendicular to the first mating face.

8. An electrical connector compatible to standards of Universal Serial Bus (USB) and External Serial Advanced Technology Attachment (eSATA) protocols, comprising:

an insulating housing defining a mating cavity with a front opening and a tongue portion extending in the mating cavity in a first direction, the tongue portion defining a first mating face and a second mating face;

a set of first USB contacts, each comprising a contacting section disposed in the first mating face of the tongue portion and a leg section;

a set of second USB contacts, each comprising a contact section disposed on the first mating face and a leg section;

a set of first ESATA contacts, each comprising a contacting section disposed on the second mating face and a leg section;

a set of second ESATA contacts, each comprising a contacting section disposed on the second mating face, the contacting section extending from the contacting section of the second USB contacting portion without leg portion.

9. The electrical connector as described in claim 8, wherein the contacting portions of the set of the second eSATA contacts are located at two sides of the set of the second eSATA contacts respectively in a same plane.

10. An electrical connector comprising:

an insulative housing defining a base with a mating tongue extending forwardly therefrom, said mating tongue defining opposite first and second surface;

a plurality of first contacts disposed in the housing with corresponding deflectable first contacting sections exposed upon the first surface;

a plurality of second contacts disposed in the housing with corresponding stiff second contacting sections exposed upon the second surface; and a plurality of third contacts disposed in the housing with corresponding stiff third contacting section exposed upon the first surface in front of the deflectable first contacting sections and with corresponding stiff fourth contacting sections exposed upon the second surface beside and between the stiff second contacting sections; wherein solder tails of the first, second and third contacts are respectively arranged in different rows under condition that the solder tail of each of said third contacts extends from the corresponding third contacting section rather than the corresponding fourth contacting section.

11. The electrical connector as claimed in claim 10, wherein the solder tail of the first contact linked to the corresponding first contacting section at a first level, the solder tail of the second contact linked to the corresponding second contacting section at a second level, and the solder tail of the third contact linked to the corresponding third contacting section at a third level between said first level and said second level.

12. The electrical connector as claimed in claim 11, wherein the solder tails of the second contacts are essentially aligned with those of the third contacts in a front-to-back direction, respectively.

* * * * *